United States Patent [19]

Holbrook et al.

[11] 4,332,635

[45] Jun. 1, 1982

[54] CUP LABELING METHOD AND APPARATUS

[75] Inventors: Winnon G. Holbrook, Appleton; Adrian J. Kettenhofen, Neenah, both of Wis.

[73] Assignee: American Can Company, Greenwich, Conn.

[21] Appl. No.: 165,739

[22] Filed: Jul. 3, 1980

[51] Int. Cl.[3] ..... B65C 9/04

[52] U.S. Cl. ..... 156/256; 156/267; 156/517; 156/521; 156/567; 156/568

[58] Field of Search ..... 156/256, 264, 267, 517, 156/521, 567, 568

[56] References Cited

U.S. PATENT DOCUMENTS

| | | | |
|---|---|---|---|
| 2,791,317 | 5/1957 | Cohns et al. | 156/567 |
| 3,562,050 | 2/1971 | Hake et al. . | |
| 3,565,724 | 2/1971 | Yamaguchi | 156/521 |
| 3,598,675 | 8/1971 | Bofinger et al. . | |
| 3,676,271 | 7/1972 | Hake et al. . | |
| 3,690,997 | 9/1972 | Bofinger et al. . | |
| 4,181,555 | 1/1980 | Hoffman | 156/267 |
| 4,210,481 | 7/1980 | Wolff et al. . | |

OTHER PUBLICATIONS

Packaging Engineering, Jun. 1980, p. 44, "The Thorobred Tames a Tricky Container".

NJM, Inc. Brochure, "Thorobred Pony 350".

NJM, Inc. product description pp. 10,932S; 10,933S; and 10,935S.

*Primary Examiner*—Caleb Weston

*Attorney, Agent, or Firm*—Robert P. Auber; Stuart S. Bowie; Thomas D. Wilhelm

[57] ABSTRACT

A method and apparatus is disclosed for the labeling of soft-surfaced disposable cups—particularly those having a tapered or frustum shape—with a thin paper label (32) which provides decoration and structural rigidity to the cup. The label is cut between a die roller (30) and anvil roller (31) from a web (28) of paper having a coating of heat activable adhesive on one side, and the cut label (32) is laid on the rotating surface (37) of a vacuum drum (36). Vacuum ports (113) in the anvil roller (31) and ports (157) in the vacuum drum hold the label on the surfaces of the roller and drum during rotation. The label is heated while on the rotating vacuum drum (36) to activate the adhesive, and an indexer plate (42), having a plurality of cup holding mandrels (41), indexes a mandrel (41) holding a cup (46) into a position in which the rotated cup contacts the heated label and draws it off of the surface of the vacuum drum. The surface speed of the cup may be higher of that of the moving labels so that labels having the shape of a annulus sector will be drawn off of the drum surface onto the cup surface in proper alignment. Unlabeled cups are simultaneously provided to another mandrel (41) on the indexer plate (42) while a labeled cup is ejected from another mandrel. Thin labels having annulus sector shapes may be applied to tapered cups in this manner at high production speeds.

23 Claims, 9 Drawing Figures

CUP LABELING METHOD AND APPARATUS

TECHNICAL FIELD

This invention relates to methods and machines for labeling and decorating preformed containers.

BACKGROUND ART

Numerous machines have been developed for the application of paper labels to formed articles such as bottles, cans, cups and the like. The articles so labeled are usually rigid and have a smooth, hard and generally cylindrical surface. The labeling art for such containers has been highly developed and high quality labels can be applied to the containers at high speeds using various adhesives.

The labeling of containers that are not inherently rigid and strong presents a more difficult labeling problem. For example, the decoration of foamed polystyrene cups, which are finding increasing use as disposable cups for holding both hot and cold liquids, is difficult because of the rough surface characteristics and the softness of the cup material. The use of labels on such cups is particularly desirable, since, in addition to the decoration provided by the label, a thin paper label adhered to a thin walled polystyrene cup provides a cup structure in which the rigidity of the cup is increased dramatically over that of an unlabeled cup of similar wall thickness. However, known labeling machines are not well adapted to apply relatively thin labels (1 to 2 mils in thickness) to containers in general; nor are they adapted to apply such labels in particular to soft, rough surfaced containers such as foamed plastic cups.

Disposable cups are typically formed in the shape of a frustum of a cone, rather than a cylinder, to allow the cups to be nestably stacked for delivery. Labels to be applied to cups having a conical surface, when flat, will have the shape of a sector of an annulus, rather than being rectangular as a label applied to a cylinder would be. The shape of the label complicates the problems of handling the label, delivering it to the cup, precisely positioning it and adhering it to the surface of the cup.

DISCLOSURE OF THE INVENTION

The cup labeling apparatus of the invention is capable of providing high speed labeling of soft surfaced cups, such as those formed of foamed polystyrene, and is well adapted to cut and apply labels of thin paper on the peripheral surface of cups having the shape of a frustum of a cone. The cups so produced have markedly greater strength and rigidity than a foamed plastic cup of similar weight which has not been labeled. Cups having intricate and precisely positioned label decorations can be formed at speeds high enough that the cost of a cup produced in this manner is substantially lower than the cost of unlabeled plastic cups having similar structural strength and comparable decoration.

The thin labeling stock is initially provided in the preferred form of a roll of label paper having a coating of heat activable adhesive on one side. In a preferred embodiment adapted to the labeling of frustum-shaped cups, the labeling stock unwound from the roll is cut into the shape of a sector of an annulus which is then transferred, adhesive side up, to a moving heating surface. The cut label is heated on the moving surface to activate the adhesive, and is then placed into moving contact with the surface of the cup to be labeled. The surface of the cup is rotated at a tangential speed which is greater than the tangential speed of the surface upon which the label is carried, so that the label is drawn off the heating surface and onto the surface of the cup in proper alignment. Only light contact is required between the heating surface and the cup in order to effect the label transfer—in contrast to typical printing decoration systems which require significant pressure contact between the cup and the printing plate in order to achieve proper transfer of the print to the irregular cup surface. The use of heat activable adhesive is desirable since such adhesive quickly develops tack after transfer of the label to the cool cup surface, minimizes wrinkling of the label on the cup surface, and provides relatively strong integral adherence of the label to the cup during use.

In a preferred embodiment of the machine of the invention, the web of labeling stock from the roll is passed through a label cutting station which includes a die roller having raised pattern cutting edges and an anvil roller rotating in contact with such edges to sever an annulus sector shape from the labeling stock web as the web passes between the two rollers. The waste stock is passed downwardly to a disposal bin, while the severed label is held on the surface of the anvil roller by vacuum applied to small ports in the surface of the roller located underneath the severed label. The unheated anvil roller transfers the cut label, adhesive side facing the anvil roller, to a release position proximate to the rotating surface of a labeling drum. The labeling drum surface also has small ports therein to which vacuum draw is applied at a position at which the labels meet the surface of the drum. At this point, a manifold associated with the anvil roller cuts off the supply of vacuum to the ports in its surface which adjoin the drum surface, and instead supplies air under pressure to these ports to drive the cut label from the anvil roller surface to the drum surface. The cut labels are retained on the rotating drum surface, adhesive side facing away from the surface, by the vacuum draw on the drum ports.

As the drum rotates, heat is applied to the labels held on its surface to activate the adhesive on the labels. Such heat may be applied for example, by internally heating the drum, or by externally applying radiant or convection heat. Continued rotation of the drum surface brings the heated labels to a position at which they contact the peripheral surface of a cup maintained with its line of contact with the drum surface disposed perpendicularly to the tangential direction of rotation of the drum. The cup is rotated at a surface speed greater than the speed of the drum surface to cause the label to be drawn onto the cup surface.

The cups are brought to the drum by an indexer assembly having a rotating indexer plate and several cup holding mandrels regularly spaced about the periphery of the plate. Cups are fed to a mandrel located at an intake position remote from the drum and are drawn onto the surface of the mandrel by vacuum suction applied to the end of the mandrel. Each mandrel preferably has the shape of the inner surface of the cup so that, as the cup is drawn tightly to the mandrel, the inner surface of the cup firmly engages the outer surface of the mandrel to facilitate firm contact between the surfaces of the cup and the rotating vacuum drum.

The indexer assembly is constructed so that the mandrels disposed about the indexer plate will be rotated to specific positions and then caused to dwell at such positions while, simultaneously, a cup is fed to one mandrel, a label is transferred to a cup on another mandrel, and a labeled cup is ejected from a third mandrel. When a mandrel is indexed into position to have the cup thereon contact the surface of the vacuum drum and receive its label, a mandrel drive wheel engages the shaft on which the mandrel is mounted to rotate it at the proper speed for pickup of the label. To facilitate the transfer of the label from the vacuum drum, a manifold which supplies vacuum draw to the vacuum chamber within the drum operates to shut off the vacuum to the ports on the drum surface at or near the point where the cup contacts the drum. After the label has been transferred to the cup, the mandrel with the labeled cup thereon indexes to a release position wherein an internal manifold in the indexer assembly cuts off the vacuum to the mandrel and supplies air under pressure to blow the labeled cup off the mandrel and into a delivery tube.

The label and cup handling components of the apparatus are synchronized to properly position the cut labels onto the surface of the cup. The synchronization is required since the label must be precisely positioned on the cup, and the labels themselves must be cut to properly contain any decoration thereon.

Further objects, features, and advantages of the invention will be apparent from the following detailed description taken in conjunction with the accompanying drawings.

BEST MODE FOR CARRYING OUT THE INVENTION

Figure 1:
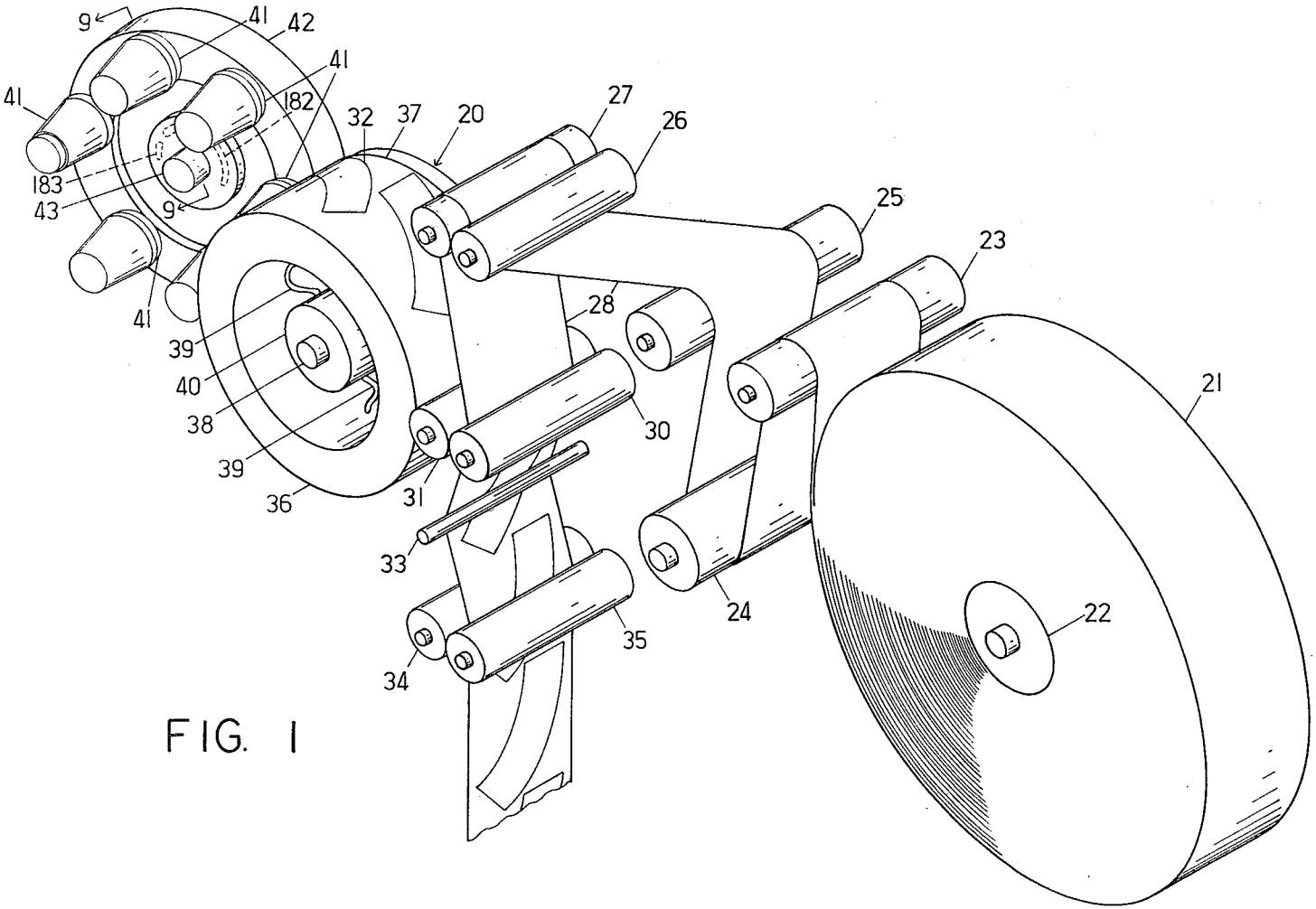
FIG. 1 is a schematic perspective view of the major components of the cup labeling apparatus in accordance with the invention.

With reference to the drawings, a schematic perspective view of a preferred embodiment of cup labeling apparatus in accordance with the invention is shown generally at 20 in FIG. 1. Labeling stock is provided from a roll 21 carried on a core 22 and is fed over a guide roller 23, a dancer roller 24 and another guide roller 25 to a pair of intake rollers 26 and 27. The dancer roller 24 cooperates with the guide rollers to apply proper tension to the web of coated paper stock as it is unrolled, in a manner which is common to machines utilized in the paper industry for feeding rolled paper stock. The paper utilized in the labeling of cups in the present invention is preferably in the range of 1 to 2 mils thick, having a basis weight from about 9 to 20 lbs. per ream (3,000 sq. ft.). One of the surfaces of the paper has a hot melt adhesive coating which may have various formulations, typically comprising a mixture of wax and polymer. For example, the hot melt adhesive may be formed of a 30% by weight mixture of ethylene vinyl acetate, 10% by weight styrene tackifier, and about 60% by weight microcrystalline wax. Such a composition is merely illustrative, since in the present invention the only requirement of the adhesive on the paper is that it be capable of melting rapidly and solidifying at moderate temperatures.

After passing through the intake rollers 26 and 27, the web of label stock 28 is passed between a die roller 30 and a backup anvil roller 31. A raised knife-edged die (not shown in FIG. 1) on the die roller 30 severs the desired label shape 32 away from the surrounding portion of the label stock as the stock web is pressed between the knife edges of the die and the surface of the anvil roller 31. The waste trim portion of the label stock is passed over a tensioning bar 33 and between a steel trim roller 34 and a rubber backup trim roller 35 downwardly to a discard receiving bin (not shown).

The severed labels 32 are retained on the surface of the anvil roller 31 by vacuum suction applied to small ports therein (not shown in FIG. 1) and are thereafter delivered, as the anvil roller rotates, to the surface of a synchronously rotating vacuum drum 36. The drum 36 has a smoothly polished surface 37 with many small ports positioned to align with the labels that are laid upon the surface. As the drum 36 rotates about a central shaft 38, a portion of which is shown in FIG. 1, the labels, held on the drum surface by vacuum applied to the ports in the surface, are heated to activate the hot melt adhesive on the outward facing side of each label. The heating of the labels can be accomplished in various ways; one way, as described below, is to utilize electrical resistence heaters mounted within the drum just beneath the surface of the drum, although it is apparent that radiant and convection heaters can also be used. Vacuum draw is supplied to the ports in the drum by conduits 39 extending from an air and vacuum supply manifold 40 mounted adjacent to the drum.

The above described severing of a label from a continuous web is preferred since the thin, adhesive coated label is always supported by contact with a roller or the vacuum drum until it reaches the cup. Standard label stack feeding apparatus is not well adapted to handling such labels, because the labels tend to stick to one another when one is picked from the stack, and the lack of rigidity in the labels allows them to fold and jam during handling. Stack feeding may be utilized to feed labels to the drum 36 where thicker labels having low adhesion between the labels in the stack are provided.

It is apparent that the vacuum drum 36 could be used directly as the anvil for the die roller, eliminating the anvil roller 31, with the cut labels remaining on the drum surface as they are severed from the web. However, the provision of the anvil roller 31 is preferred because the surface in contact with the die edges tends to wear and the small anvil roller can be more economically replaced than the vacuum drum.

Rotation of the drum surface brings each label sequentially into a position where it can contact a formed plastic cup held by one of the mandrels 41 carried on a rotating indexer plate 42. Clockwise rotation of the indexer plate 42 about a central shaft 43 to which it is mounted brings a respective one of the mandrels 41, carrying a formed cup thereon, into a labeling position in which the surface of the cup is in light contact with the moving heating surface 37 of the drum 36, with each mandrel dwelling in this position until transfer of the label to the cup is completed. Each of the mandrels 41 is mounted to rotate about its axis of symmetry and is driven, when it reaches the labeling position adjacent the drum, so as to rotate at a tangential speed which is higher than the tangential speed at which the drum is moving. As a result, after the surface of the cup contacts the melted adhesive on each label, the movement of the surface of the cup will draw the label off of the drum surface and pull it onto the surface of the cup with a proper orientation of the label on the cup.

Figure 2:
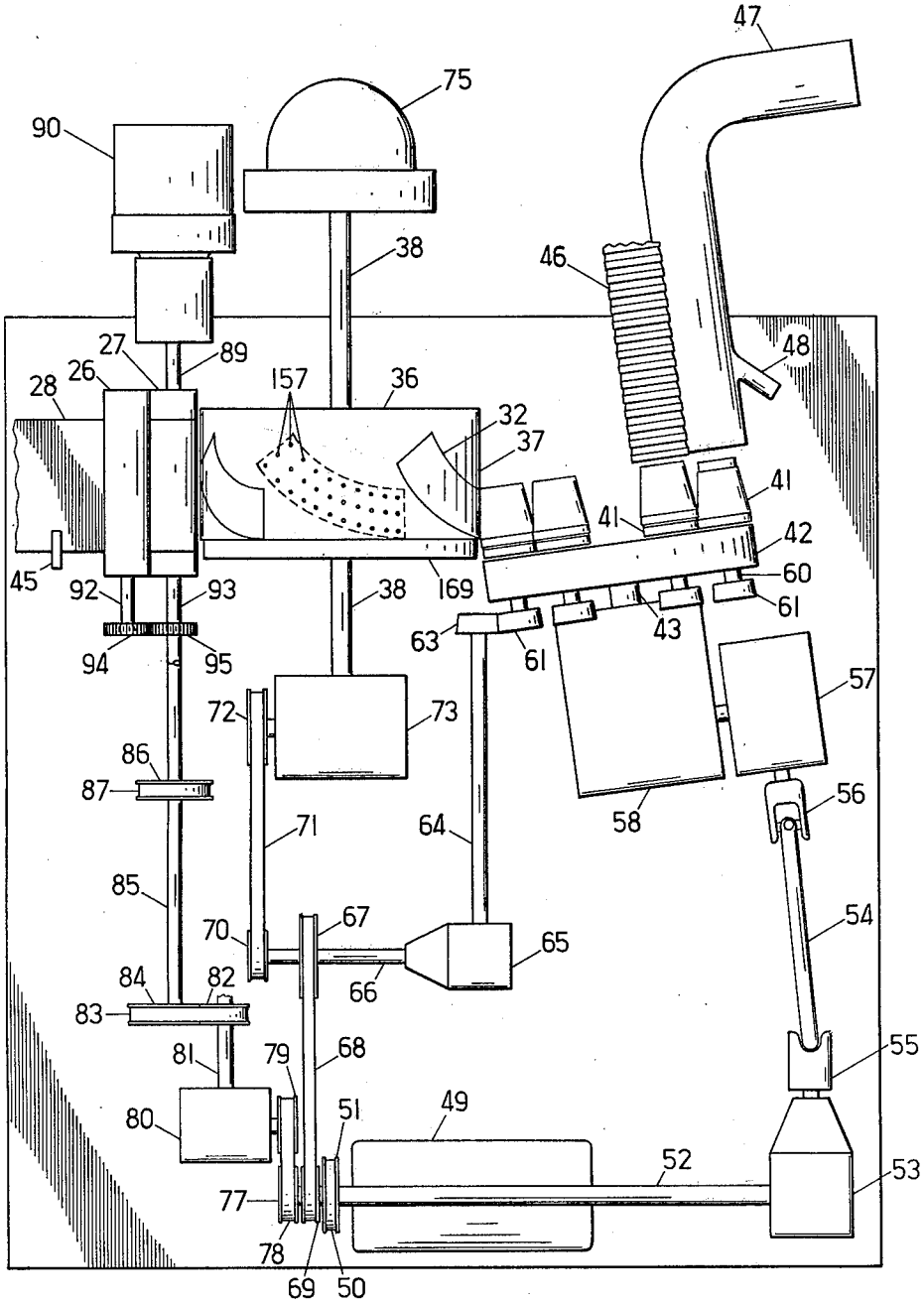
FIG. 2 is a plan view of the apparatus showing the supply of synchronized power to the major components thereof.

Drawing of the label off the drum in the above described manner causes an annulus shaped label to be pulled in its track onto the cup surface so that the line of contact between the label and the cup is always along a radial line between the two curved edges of the label. As shown in FIGS. 1 and 2, the cut labels 32 are disposed on the surface of the drum such that the leading edge of the label will intersect the line perpendicular to the direction of drum rotation at which the cup itself contacts the drum; whereas the trailing edge of the label extends away from the position at which the cup contacts the drum. The cup physically draws the label across the surface of the drum—to which the label is only weakly held by the force of vacuum, which is preferably shut off at the point of contact of the label to the cup. The manifold 40 can be constructed, as described below, to shut off the vacuum to the ports on the drum surface in the vicinity of the area where the cup surface contacts the drum to facilitate the release of the label from the surface. In addition, air under pressure may also be provided to the manifold to blow air out through the ports at the portion of the drum surface facing downwardly to blow off any labels which did not transfer properly to the cups and which remain on the drum surface.

The roll of label stock 21 may be mounted on a carriage (not shown), along with the guide rollers 23 and 25 and the dancer roller 24, to allow the position of the web of label stock to be laterally adjusted so that the die on the die roller 30 cuts the label stock at the proper position. This positioning can be important if the label is decorated, since the entire decoration should be properly centered on the cut label. Such carriage mechanisms are well known in the paper handling art, and are commonly used in printing machines.

FIG. 2 is a plan view of the apparatus of the invention which illustrates the supply of synchronized power to its components. The various bearings and supports required to carry drive shafts and the like are not shown in FIG. 2 for purposes of clarity in illustration. As shown in this view, the web of paper 28 passes into the intake rollers 26 and 27 and is cut into the labels 32 which are delivered to the heating surface 37 of the vacuum drum 36. The lateral position of the web 28 is sensed by an air operated position sensor 45 which adjusts the lateral position of the carriage holding the label stock roll in a manner well known in the art. The formed cups to be labeled may be delivered to the mandrels 41 by any convenient means, and a stack of such cups 46 is shown being fed to a mandrel in an intake position in FIG. 2. A completely labeled cup is ejected from the mandrel on which it rests at a release position by a burst of air under pressure which drives the cup into a tube 47, supplied with air flow from a branch 48, which delivers the cup to the location where the cups are stacked for delivery.

Power to drive the various components in a synchronized manner is provided from an electric motor 49 through a belt 50 to a timing pulley 51 which turns a main drive shaft 52. Power is taken off the main drive shaft through a right angle gear box 53; a universal drive shaft 54, having universal joints 55 and 56 at its respective ends; and a 10 to 1 speed reducer 57, which directs the power at right angles to an indexing cam unit 58. The cam mechanism 58 drives the main shaft 43 of the indexer assembly on which the indexer plate 42 is mounted, and is a commercially available mechanism which provides a sequential 1/6 arc rotation followed by a selected dwell time during which one of the mandrels 41 is adjacent the drum surface 36 for pick-up of a label therefrom. Each mandrel 41 is mounted for rotation on a mandrel shaft 60 which is journaled to the plate 42, and a beveled friction wheel 61 is mounted on the end of each shaft 60 opposite the mandrel. As each mandrel comes into position to have the cup thereon pick up a label from the drum 36, the wheel 61 comes into frictional contact with a drive wheel 63 which is powered to drive the friction wheel 61 at a speed such that the tangential surface speed of a cup held by the mandrel is substantially faster than the tangential speed of the surface 36 of the vacuum drum. For example, a cup surface speed three and one half that of the drum surface has provided satisfactory results. The drive wheel 63 is mounted on a mandrel drive shaft 64, which is driven through a right angle gear box 65 to a jack shaft 66, which itself has a timing pulley 67 mounted for rotation therewith. A belt 68 connects the pulley 67 to a timing pulley 69 which is mounted for rotation with the main drive shaft 52.

Power is also taken off of the jack shaft 66 through a stub end timing pulley 70, a belt 71, a second timing pulley 72, and a right angle speed reducer 73 to the vacuum drum shaft 38. A slip ring power coupling 75 is mounted to the end of the shaft 38 to provide an electrical connection between an outside power source and internal wires within the rotating drum 36.

Another timing pulley 77 is mounted to the end of the drive shaft 52 and is connected by a belt 78 to another timing pulley 79 which drives a speed reducer 80. The power output of the speed reducer is provided on a shaft 81 to a pulley 82 connected by a belt 83 to a pulley 84, which is itself connected for rotation with a roller drive shaft 85. A timing pulley 86 is mounted for rotation with the drive shaft 85 and drives, through a belt 87, the trim rollers 34 and 35 (not shown in FIG. 2).

The power from the shaft 85 is also delivered to the die and anvil rollers 30 and 31 (not shown in FIG. 2). A shaft 89 extends from the anvil roller to a shaft position sensing unit 90 which determines the angular position of the shaft for purposes described in further detail below.

The mounting shafts 92 and 93 of the intake rollers 26 and 27 are connected together by spur gears 94 and 95 mounted to the end of the shafts 92 and 93, respectively. The shaft 93 is shown cut in FIG. 2, since power is preferably delivered to the shaft through a variable gear reducing mechanism, as described below, which allows adjustment of the input feed rate of the web 28 into the nip formed between the die and anvil rollers.

Figure 3:
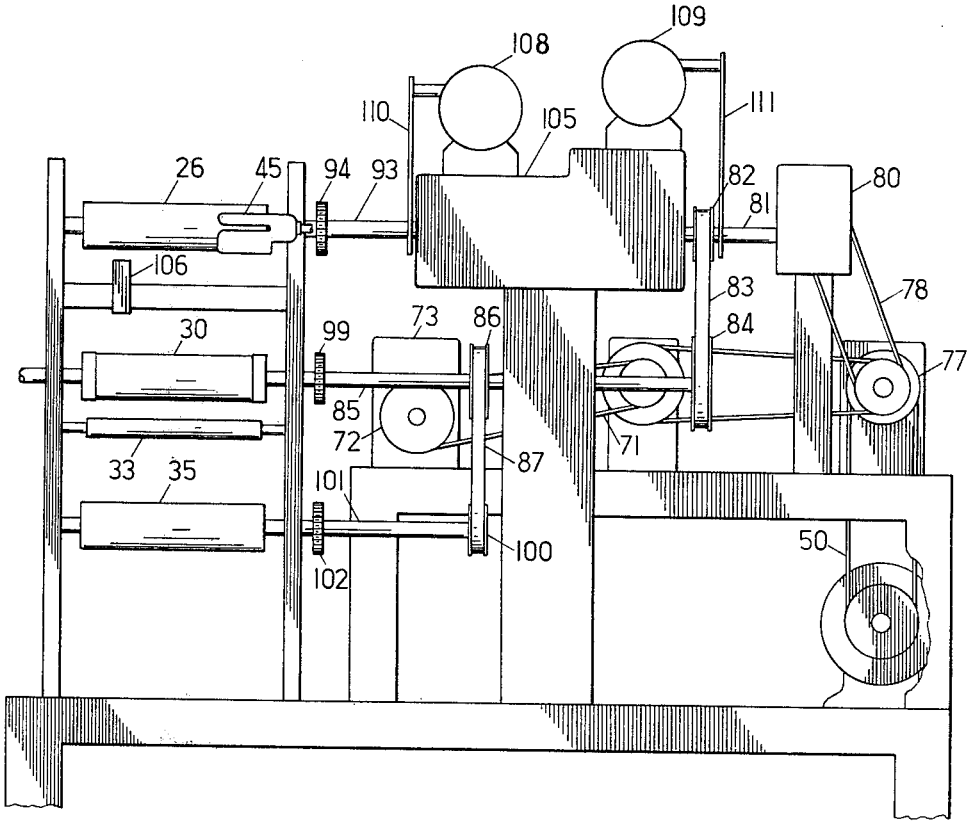
FIG. 3 is a side elevation view of the apparatus as seen from the left side of the view of FIG. 2.

The feeding of the labeling stock web to the anvil and die rollers is best shown with reference to the side elevation view of FIG. 3. As noted previously, the paper is passed through the air pressure edge sensor 45, under the intake roller 26 and over the roller 27, and then downwardly into the nip formed between the die roller 30 and the anvil roller 31. The waste trim left after the labels have been cut is passed over the tensioning roller 33 and down between the trim rollers 34 and 35 to a waste receptacle. The anvil roller 31 is directly coupled to the shaft 85 and is driven therewith, while the die roller 30 is driven by a spur gear 99 which is engaged with another spur gear (not shown) mounted to the shaft 85. The trim rollers 34 and 35 are driven off of the belt 87, through a pulley 100 mounted on a shaft 101 which is directly connected to drive the trim roller 34 (not shown in FIG. 3). The trim roller 35 is driven by a spur gear 102 engaged with another spur gear (not shown) which is mounted on the shaft 101. It is thus seen that the trim rollers 34 and 35 will always be rotated in synchrony with the die and anvil rollers.

The shaft 93 that turns the intake rollers 26 and 27 is driven by a differential transmission 105, available commercially, which is provided with power from the connecting shaft 81. The differential transmission 105 adjusts the speed of rotation of the rollers 26 and 27 to advance or retard the incoming web of printed paper to place the printing in the proper position for subsequent cutting by the die on the die roller. The position of the printed material is sensed by a photoelectric eye sensor 106 which detects the passage of a marking on the incoming paper web. The position of the decoration on the paper is then compared with the angular position of the anvil roller, as determined by the shaft position sensing unit 90, and a correction is applied to the differential transmission 105 by either a first reversible D.C. motor 108, for fine corrections, or a second reversible D.C. motor 109, for course corrections. These motors are connected to adjust the differential within the transmission 105 through connecting chains 110 and 111, respectively. Such position adjustment and detection units, and the control components utilized with them, are commercially available and familiar to those skilled in the art.

Figure 4:
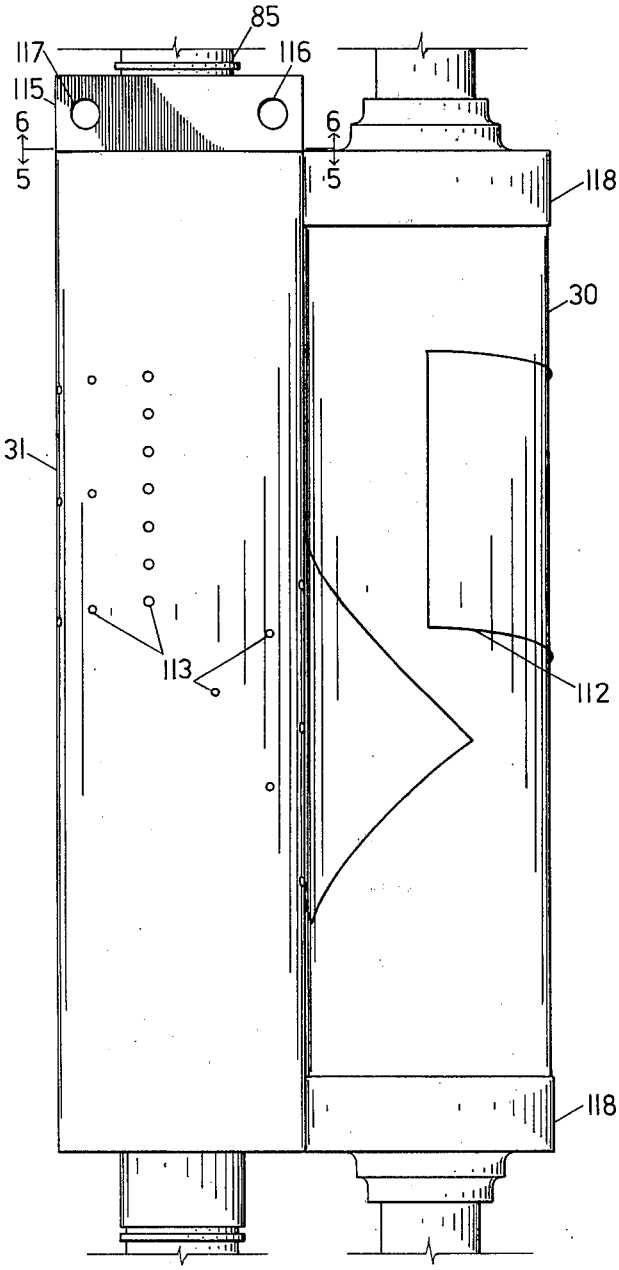
FIG. 4 is a top plan view of the anvil roller and die roller portion of the apparatus.

As seen in the detailed view of the die roller 30 and anvil roller 31 of FIG. 4, the die roller 30 has a raised cutting edge 112 defining a cutting pattern. The cutting edge 112 may be formed by machining of the parent roll stock to leave the cutting edge pattern above the remainder of the die roller surface, hardening the roller, and sharpening the cutting pattern to a knife edge. Raised bearing surfaces 118 are left on either end of the die roller and are maintained in rolling contact with the surface of the anvil roller. The cutting edges 112 lie just below the level of the bearing surfaces 118 such that the edges are not in hard contact with the anvil roller surface. The edges of the die 112 would, if laid flat, define the outer periphery of the annulus sector in which the labels are to be cut.

Figure 5:
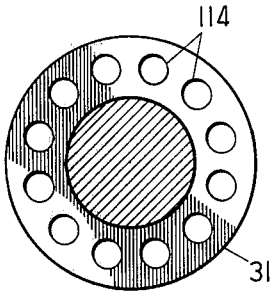
FIG. 5 is a view of an end of the anvil roller taken along the lines 5—5 of FIG. 4.
Figure 6:
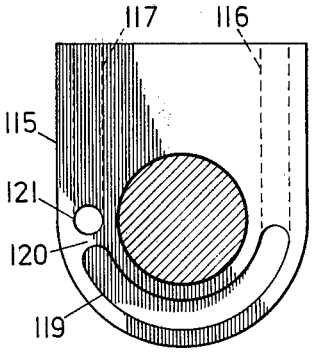
FIG. 6 is an end view of the surface of the anvil roller pressure and vacuum manifold taken along the lines 6—6 of FIG. 4.

The hard surfaced anvil roller has a pattern of small surface ports 113 distributed in position to underlie a label cut by the die edges at locations inwardly adjacent the edges of such a label. An additional line of surface ports in the anvil roller extends along the length of the pattern in approximately the middle of a label cut by the die 112. These ports communicate with a series of cavities 114 bored longitudinally through the body of the anvil roller, shown in FIG. 5, which are normally supplied with vacuum draw. As a result, as a label is severed from the surrounding paper web by the engagement of the knife edges of the die 112 with the surface of the anvil roller 31, the severed label will be drawn and held to the anvil roller surface by the vacuum applied through the ports 113. As seen in FIG. 4, the outline of the shape described by the outer ports 113 is essentially that of an annulus sector wrapped about the cylindrical surface of the anvil roller.

As a portion of the label carried on the anvil roller is brought into proximity with the surface 37 of the vacuum drum 36, it is desirable that the label readily release from the anvil roller surface and be drawn onto the drum surface. To aid this release, the vacuum draw supplied to the ports 113 is cut off at a position adjacent the vacuum drum, and, to provide a positive displacement of the label away from the anvil roller, air pressure may be supplied to the ports. The control of the vacuum and air supplied to the anvil is accomplished through a manifold 115 supplied with vacuum draw through a conduit 116 and with air under pressure through a conduit 117. As shown in the end view of the manifold 115 in FIG. 8, the vacuum conduit 116 terminates in communication with a vacuum groove 119 formed in the flat inner radial face of the manifold which extends over a semicircular arc. The flat faces 120 of the inner surface of the manifold abut the flat radial surface of the end of the anvil roller 31 and place the groove 119 in communication with the bores 114 through most of the rotation of the anvil roller. At the ends of the groove 119 the surface 120 of the manifold cuts off the supply of vacuum to those bores 114 which are coming into proximity with the vacuum drum surface; and, ultimately, one of the bores 114 comes into communication with a recess 121 in the surface of the manifold which is connected to the air pressure conduit 117, thus delivering air under pressure to the ports 113 on the surface of the roller which extend into this particular bore 114.

Figure 7:
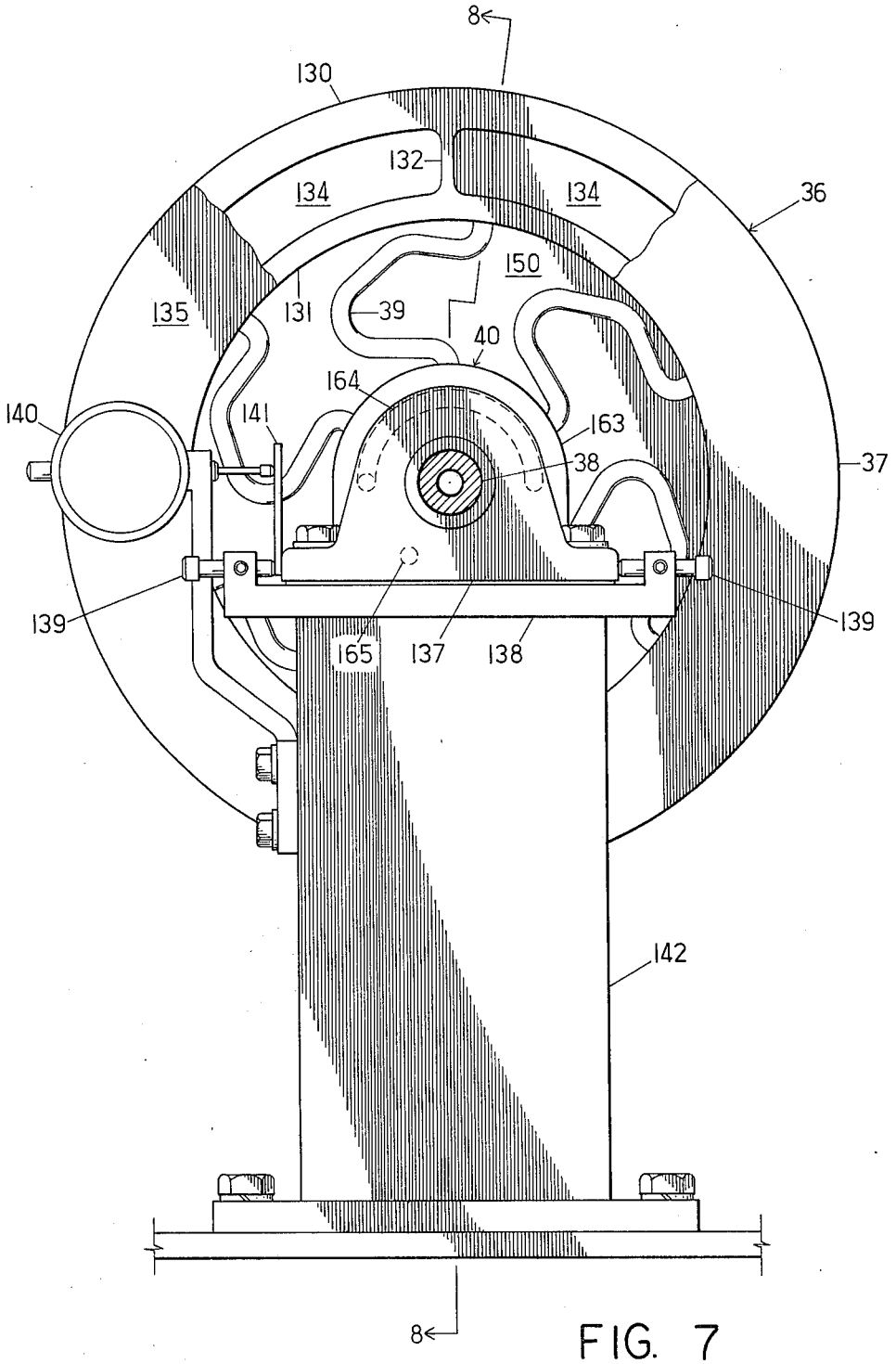
FIG. 7 is a front elevation view of the labeling drum assembly portion of the apparatus.

As described generally above, the cut labels 32 are held on the surface of the vacuum drum by vacuum draw action and are heated by contact with this surface. A detailed view of the vacuum drum, with portions thereof broken away for purposes of illustration, is shown in FIG. 7. The vacuum drum assembly is composed of an outer cylindrical drum 130, whose outer polished surface 37 carries the cut labels, and an inner cylindrical drum 131 of smaller diameter spaced away from the outer drum, with the chamber defined between the two drums being divided by seals 132 to define several air flow cavities 134. The front faces of the outer and inner drum are covered, and the cavities 134 sealed off from the atmosphere, by a front face plate 135. The drum shaft 38, carrying the drum assembly, is journaled to a pillow block 137 which rests upon a slide plate 138. Adjustment screws 139 are threaded through elbows at either end of the slide plate 138 and into contact with the base of the pillow block 137 to allow lateral adjustment of the position of the drum to a high degree of accuracy; adjustment of the screws 139 allows the drum to be accurately placed adjacent to the surfaces of the anvil roller and a cup held by a mandrel 41. The position of the drum is measured by a plunger type rotary gauge 140 in contact with a plate 141 attached to the pillow block 137. The plate 138 is itself mounted rigidly to a front support frame 142 which rests on the machine frame.

Figure 8:
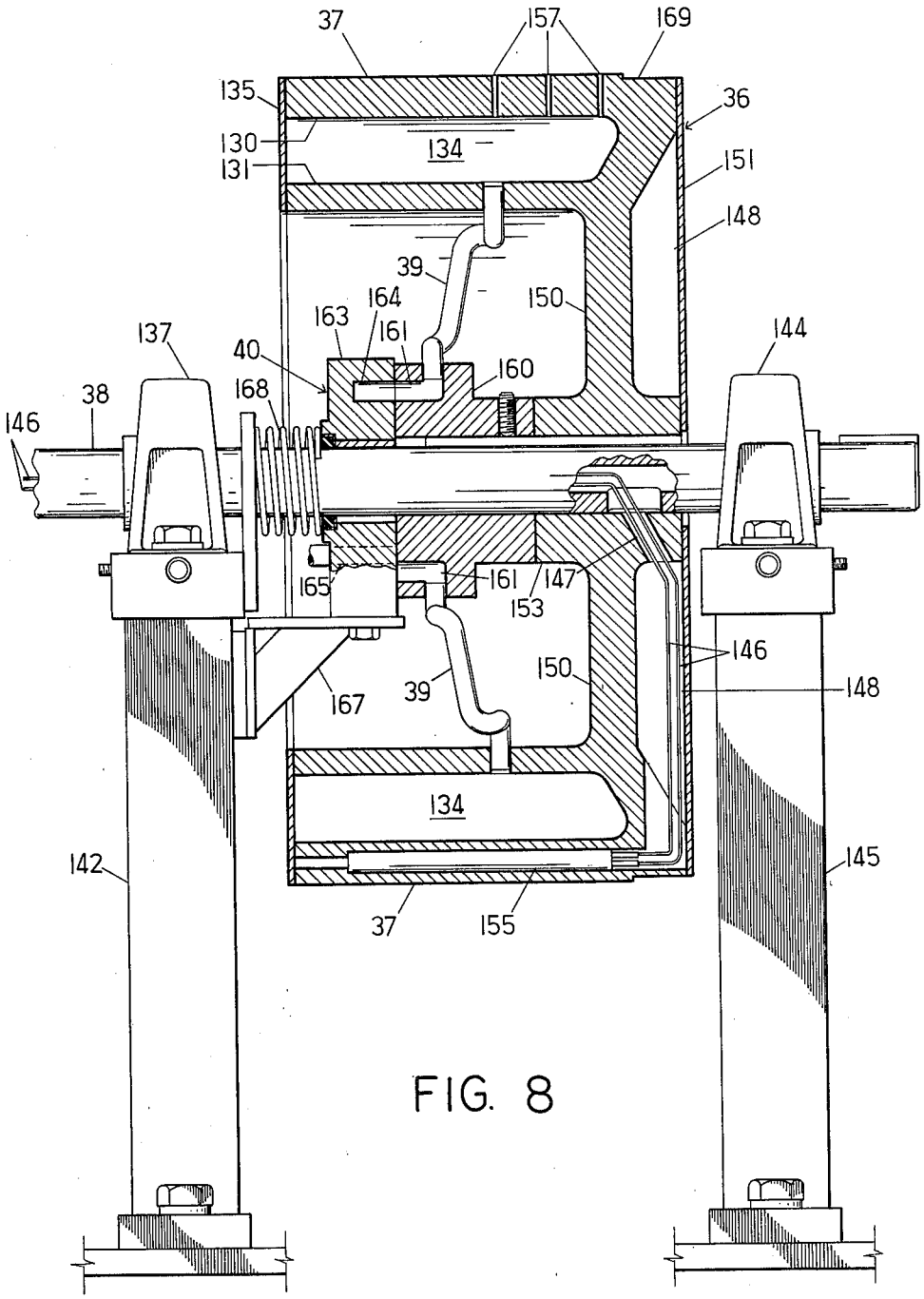
FIG. 8 is a cross-sectional view of the labeling drum assembly taken generally along the lines 8—8 of FIG. 7.

As shown in the cross-sectional view of FIG. 8, the drum shaft 38 is supported at the rear of the drum by a second pillow block 144 mounted on a rear support frame 145. Wires 146 carrying current from the slip ring unit 75 (not shown in FIG. 8) are extended through the hollow core of the drum shaft 38 and through channels 147 to a chase 148 defined within the drum between a radial support plate 150, which carries the inner and outer drum 131 and 130, and a back cover plate 151. The radial plate 150 is formed integrally with a spindle 153 which is keyed to rotate with the drum shaft 38. The wires 146 extend through the chase 148 to electrical resistence heaters 155 emplaced in cavities in the outer drum 130 just beneath the surface 37 in position to heat the metal of the surface by conduction.

The cavities 134 are provided with either vacuum draw or air under pressure through the conduits 39. The air pressure within the cavities 134 is communicated to the surface 37 of the drum through small ports 157 extending from the drum surface to the cavities. As best shown in FIG. 2, ports 157 are spaced and disposed about the surface to underlie cut labels placed on the surface and to apply vacuum to the labels at points which are just inwardly adjacent to the outer edges of the label. The conduits 39 are connected to a rotor portion 160 of the drum manifold 40, which is keyed to the drum shaft 38 and therefore rotates with the drum. The rotor 160 has internal channels 161 formed therein which are directed to the radial face of the rotor; this rotor face slidingly abuts the inner radial face of a stator portion 163 of the manifold. The stator 163 has an internal channel 164 therein which is selectively in and out of communication with the channels 161 in the rotor. The channel 164 in the stator is supplied with a source of vacuum draw and is formed in an arc, as shown in dashed lines in FIG. 7, which allows vacuum pressure to be supplied to the surface of the vacuum drum for most of the portion of its circumference on which labels are held. A second channel 165 formed in the stator is positioned to engage with the particular rotor channel 161 which is in communication with the cavity 134 which is located, at that time, past the mandrel labeling position but ahead of the position of the anvil roller. The stator channel 165 is provided with air under pressure to thereby blow off any labels which have remained on the drum and have not transferred to cups. The positions of the channels 164 and 165 are arranged so that the portion of the stator face between them blocks off the channels 161 in the rotor leading to the cavity 134 which is under a label which is in position to be transferred to the surface of a cup. Each set of ports 157 in the surface of the drum which defines the outline of a label is formed over one of the cavities 134. Thus, when the vacuum is cut off to one of these cavities, the entire label above it is ready to be released.

The stator portion 163 of the drum manifold is supported by a bracket 167 and is tightly pressed against the face of the rotor portion by the force of a compression spring 168.

As shown in the cross-sectional view of FIG. 8 and in FIG. 2, a strip 169 along the back edge of the drum is indented from the remainder of the drum surface 37. The indented strip 169 is recessed far enough from the remainder of the surface of the drum that it does not contact a cup being labeled or particularly the raised lip typically formed on the open end of the cup.

Figure 9:
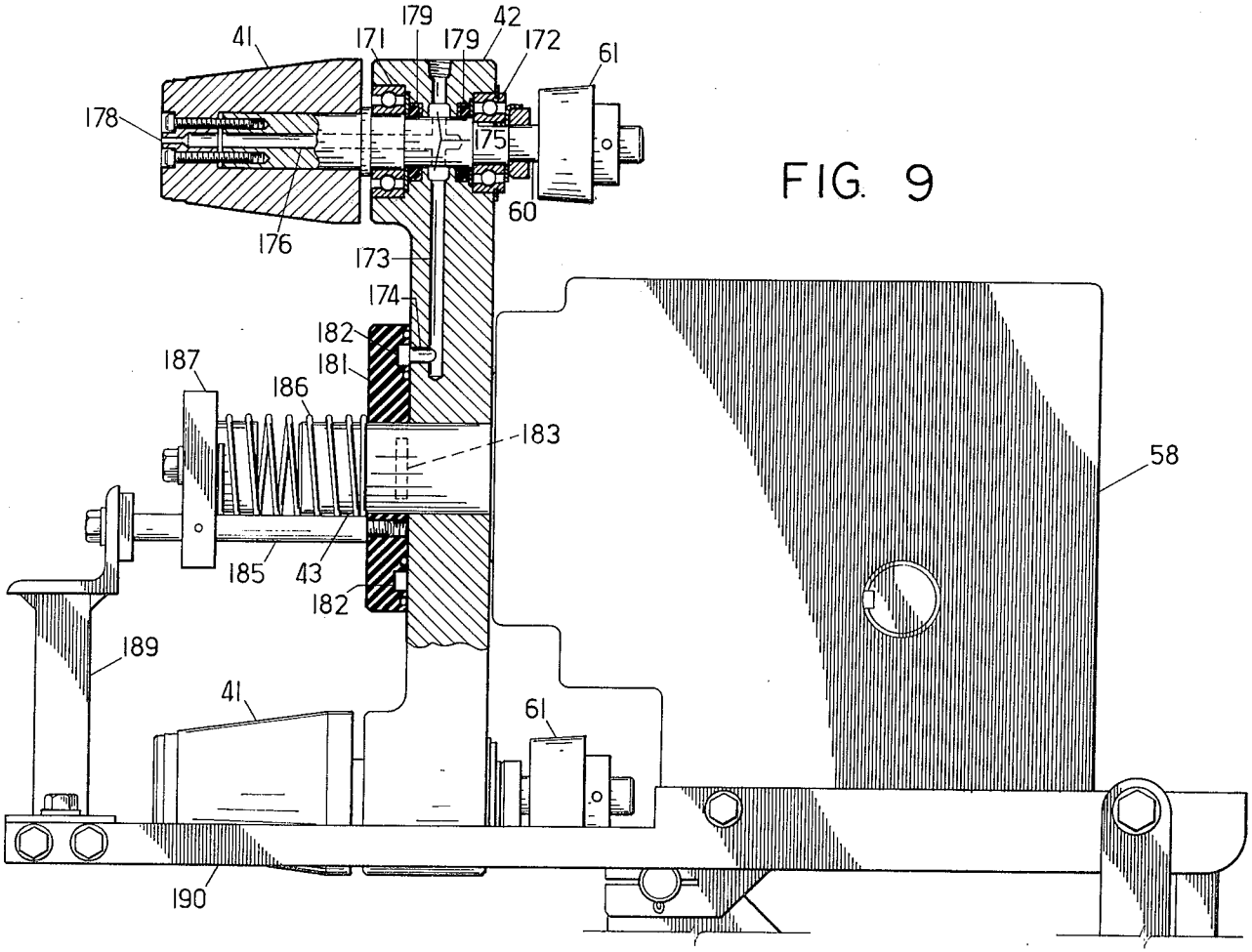
FIG. 9 is a partial cross-sectional view of the indexer assembly taken generally along the lines 9—9 of FIG. 1.

A detailed view of the indexer assembly portion of the machine 20 is shown in FIG. 9, in which portions of a mandrel, its mounting, and the indexer plate have been broken away to illustrate the internal construction of these components. As indicated above, the plate 42 is rotated on a central shaft 43 which is driven by a commercially available indexing cam unit 58. The shafts 60 carrying the mandrels 41 are journaled for rotation to the plate 41 with bearings 171 and 172. Internal channels 173 in the indexer plate communicate from an opening channel 174 in the front rotary face of the indexer plate to annularly shaped channels 175 which each extend around one of the shafts 60. The annular channels 175 communicate with channels 176 extending through the length of the shafts 60. The channels 176 terminate in orifices 178 on the front faces of the mandrels 41. Thus, vacuum pressure applied to one of the mandrel shaft channels 176 will pull the bottom end of a cup tightly toward the orifice 178 and thereby hold the cup tightly on the mandrel during the labeling process; and conversely, when air under pressure is applied to the channel 176, the air passing out of the orifice 178 will blow the cup off of the mandrel with considerable force. The annular channels 175 formed around the shafts 60, and the channels 176 within the shafts are sealed off from the atmosphere by sealing rings 179.

The supply of vacuum or air pressure to the channels 173 and 174 is controlled by a stationary indexer manifold 181 mounted with a flat radial face abutting and sliding against the flat front radial surface of the indexer plate 42. A first channel 182 formed within the manifold is connected to an exterior source of vacuum and is so arranged as to supply vacuum to the channels 174 and 173 leading to all mandrels at and between the intake and labeling positions. At the release position, at which a mandrel is disposed in front of the discharge tube 47, a second channel 183 (shown in dashed lines in FIGS. 9 and 1), supplied with an external source of air pressure, comes into communication with the channels 174 and 173 which lead to the mandrel at the release position, thereby blowing the labeled cup off of the mandrel and into the tube 47. The manifold 181 is held stationary by mounting to a manifold support adaptor 185 and is held firmly against the face of the indexer plate and in sliding contact therewith by the force of a compressed spring 186 extending between the manifold and a force plate 187 mounted to the adaptor 185. The adaptor 185 is itself mounted to a manifold support arm 189 which is mounted to the support bar 190 for the indexer assembly.

It is understood that the invention is not confined to the particular construction and arrangement of parts herein illustrated and described, but embraces all such modified forms thereof which come within the scope of the following claims.

We claim:

1. Cup labeling apparatus comprising:

(a) a die roller having cutting edges on its surface defining an annulus sector cutting pattern;

(b) an anvil roller having a hard cylindrical surface which is mounted to rotate with its surface in engagement with the cutting edges on the die roller whereby a label will be severed in the shape of the cutting edge pattern from a web of paper having heat activable adhesive coated on one side which is passed between the anvil and die rollers, the anvil roller having a plurality of ports distributed over its surface which are positioned to underlie a label cut by the cutting edges;

(c) means for providing a vacuum draw to the ports on the surface of the anvil roller to hold a severed label thereon as the roller is rotating and to release the vacuum draw at a selected position such that the label is released from the anvil roller;

(d) a moving heating surface positioned to receive a label released from the anvil roller with the heat activable side of the label facing away from the heating surface;

(e) means for heating the labels on the heating surface to activate the adhesive thereon; and (f) means for bringing frustum shaped formed cups into rotating surface contact with the heated labels on the moving heating surface at a cup labeling position including cup holding mandrels having a surface shape conforming substantially to the inner surface of the cups to be labeled, the mandrel and the cup held thereon in the cup labeling position being rotated at a surface speed which is greater than the speed of the heating surface to draw the labels off of the surface and into adhesive contact with the surface of the cups.

2. Cup labeling apparatus comprising:

(a) means for receiving a web of labeling paper having a heat activable adhesive coated on one side thereof and for cutting labels in an annulus sector shape therefrom;

(b) a rotating vacuum drum having a cylindrical heating surface positioned such that labels cut by the means for receiving and cutting a web are received by the vacuum drum surface with the heat activable side of the label facing away from the drum surface, the vacuum drum surface having a plurality of ports which are positioned to underlie the cut labels received on the surface;

(c) means for applying a vacuum draw to the ports in the drum surface to thereby hold the labels on the surface as the drum rotates;

(d) means for heating the labels on the drum surface as the drum rotates to activate the adhesive thereon; and (e) means for bringing frustum shaped formed cups into rotating surface contact with the heated labels on the vacuum drum heating surface at a cup labeling position including cup holding mandrels having a surface shape conforming substantially to the inner surface of the cups to be labeled, the mandrel and the cup held thereon in the cup labeling position being rotated at a surface speed which is greater than the tangential speed of the vacuum drum surface to thereby draw the labels off of the surface and into adhesive contact with the surface of the cups.

3. Cup labeling apparatus comprising:

(a) means for receiving a web of labeling paper having a heat activable adhesive coating on one side thereof and for cutting labels in a desired shape therefrom;

(b) a moving heating surface positioned to receive the cut labels from the means for receiving and cutting with with the adhesive side of the label facing away from the heating surface;

(c) means for heating the labels on the heating surface to activate the adhesive thereon;

(d) an indexer plate mounted for rotation;

(e) a plurality of cup holding mandrels mounted for rotation to the indexer plate and disposed about the periphery thereof, each cup holding mandrel having a front face and a peripheral surface shape conforming substantially to the inner surface of the cups to be labeled, the mandrels being positioned such that they are brought one at a time by rotation of the indexer plate into a labeling position with the mandrel surface adjacent the heating surface;

(f) a channel in each of the mandrels extending from an orifice in the front face of each mandrel to an opening at the mounting of the mandrel to the indexer plate;

(g) means for applying a vacuum draw to the channels of the mandrels such that a formed cup is drawn to the mandrel at an intake position and held at a labeling position in which the mandrel has the cup thereon in rotating contact with the moving heating surface, and for applying air pressure to the channel in a mandrel which holds a cup which has had a label applied to it when the mandrel reaches a release position;

(h) means for rotating the indexer plate such that each one of the mandrels moves in sequence to the intake position, to the labeling position, and to the release position with the mandrels dwelling at each such position for a period of time sufficient to allow the mandrel at the labeling position to contact and draw a label from the heating surface and onto the surface of the cup; and (i) means for rotatably driving the mandrel which is in the labeling position at a tangential surface speed which is greater than the speed of the moving heating surface carrying the heated label including a driven friction wheel connected to each mandrel to rotate therewith and mounted on the side of the indexer plate opposite the mandrel, and a drive wheel mounted for rotation in a position such that the driven wheel will come into frictional contact therewith when the mandrel to which it is connected is in the labeling position, the drive wheel being rotated at a speed such that the mandrel is driven at a tangential speed which is greater than the speed of the moving heating surface, whereby contact of the rotating cup with the label will cause the label to be drawn off of the heating surface onto the surface of the cup at a faster speed than the speed of the heating surface and thus maintain the label in alignment with the surface of the cup as it is being drawn off.

4. Cup labeling apparatus for applying labels having a heat activable adhesive coated on one side and formed in the shape of a sector of an annulus to a frustum shaped formed cup, comprising:

(a) a rotating vacuum drum with a cylindrical heating surface having a plurality of ports which are positioned to underlie the annulus shaped labels with the leading edge of the label perpendicular to the direction of rotation of the drum;

(b) means for supplying annulus sector shaped labels to the cylindrical surface of the rotating vacuum drum with the adhesive coated side of the label facing away from the drum surface, including:

(1) a die roller having cutting edges on its surface defining an annulus sector cutting pattern laid on the surface of the die roller;

(2) an anvil roller having a hard cylindrical surface which is mounted to rotate with its surface in engagement with the cutting edges on the die roller whereby a label will be severed in the shape of an annulus sector from a web of paper which is passed between the anvil and die rollers, the anvil roller having a plurality of ports distributed over its surface which are positioned to underlie a label cut by the cutting edges; and (3) means for providing a vacuum draw to the ports on the surface of the anvil roller to hold a severed label thereon as the roller is rotating and to release the vacuum draw at a release position such that the label is released from the anvil roller onto the surface of the vacuum drum with the adhesive coated side of the label facing away from the drum surface;

(c) means for applying a vacuum draw to the ports in the drum surface to thereby hold the labels on the surface as the drum rotates;

(d) means for heating the labels on the drum surface as the drum rotates to activate the adhesive thereon; and (e) means for bringing formed frustum shaped cups into rotating surface contact with the heated labels on the vacuum drum surface at a cup labeling position including cup holding mandrels having a surface shape conforming substantially to the inner surface of the cups to be labeled with the mandrel and the cup held thereon in the cup labeling position being rotated at a surface speed which is greater than the tangential speed of the vacuum drum surface to thereby draw the labels off of the surface and into adhesive contact with the surface of the cups.

5. The apparatus of claim 1 or 4 including means for providing air under pressure to the ports in the anvil roller surface which are adjacent to the heating surface to thereby drive cut labels off of the anvil roller surface and onto the heating surface.

6. The apparatus of claim 1 wherein the means for providing a vacuum draw to the ports on the surface of the anvil roller includes a plurality of longitudinal bores distributed about the periphery of the anvil roller under its surface with the ports above each bore extending from the surface to communication with the bore, each of the bores opening at one end of the roller to a flat radial face of the roller, a vacuum and air manifold having a flat radial surface in sliding engagement with the end of the anvil roller at which the bores open, a vacuum groove formed in the radial surface to be in communication with several of the bores such that vacuum draw is supplied to the ports on the surface of the anvil roller over a major portion of its circumference, the manifold also including an air pressure recess sized and positioned to communicate with one of the anvil roller bores at a time such that, when air under pressure is provided to the air pressure recess, air under pressure will be directed to the ports in the roller surface which are positioned adjacent to the moving heating surface to thereby drive cut labels off of the anvil roller surface and onto the heating surface.

7. The apparatus of claim 1 wherein the cutting edges of the die roller define the shape of an annulus sector wrapped over the surface of the die roller, whereby labels cut by the die roller will have the shape of an annulus sector.

8. The apparatus of claim 1 or 3 wherein the moving heating surface is a cylindrical surface of a rotating vacuum drum positioned such that cut labels are received by the vacuum drum surface, the vacuum drum surface having a plurality of ports which are positioned to underlie the cut labels received on the drum surface, and further including means for applying a vacuum draw to the ports in the drum surface to thereby hold the labels on the surface as the drum rotates.

9. The cup labeling apparatus of claim 2 or 3 wherein the means for receiving a web of paper and for cutting labels therefrom comprises a die roller having cutting edges on its surface defining a cutting pattern; an anvil roller having a hard cylindrical surface which is mounted to rotate with its surface in engagement with the cutting edges on the die roller whereby a label will be severed in the shape of the cutting edge pattern from a web of paper which is passed between the anvil and die rollers, the anvil roller having a plurality of ports distributed over its surface which are positioned to underlie a label cut by the cutting edges; and means for providing a vacuum draw to the ports on the surface of the anvil roller to hold a severed label thereon as the roller is rotating and to release the vacuum draw at a selected position such that the label is released from the anvil roller.

10. The apparatus of claim 2 or 4 wherein the vacuum drum has electrical heating elements therein mounted in position to heat the surface of the drum by conduction.

11. The apparatus of claim 2 or 4 wherein the vacuum drum includes an outer cylindrically surfaced drum and an inner cylindrical drum of smaller diameter, a radial support plate carrying the inner and outer drums in spaced relation to define a chamber between them, a plurality of seals mounted to divide the chamber between the inner and outer drums into a plurality of air flow cavities, the ports extending through the outer drum to communication with the flow cavities beneath such ports, and a central shaft fixedly mounted to the radial support plate and mounted for rotation on either side of the drum.

12. The apparatus of claim 2 or 4 wherein the means for applying a vacuum draw to the ports in the drum surface includes a manifold rotor portion mounted to rotate with the vacuum drum and having a plurality of channels therein, the rotor manifold having a flat radial face on which each of the channels therein terminates; conduits connecting each of the channels in the rotor to one of the cavities in the vacuum drum to provide communication therebetween; a manifold stator portion having a flat radial face in abutting, sliding contact with the flat radial face of the manifold rotor, the stator having a channel formed in its radial face which is in communication with those channels in the rotor which are in communication with the cavities in the drum underlying the position of labels on the drum between the anvil roller and a cup in the cup labeling position, and an air pressure channel formed in the stator radial surface which is positioned to communicate with the channel in the radial face of the rotor which is itself in communication with a cavity in the drum which underlies a position on the drum which is between the cup labeling position and the position at which cut labels are released to the vacuum drum surface, whereby application of vacuum draw to the stator vacuum channel will provide suction to the ports in the surface of the drum to hold labels on the surface between the release of labels to the surface and the label applying position, and whereby the application of air under pressure to the air pressure channel in the stator will cause air to be passed out through the drum surface ports to drive off any labels remaining on the drum after the cup labeling position has been passed.

13. The apparatus of claim 2 or 4 wherein the vacuum drum has an indented strip along one edge of its outer cylindrical surface to allow a formed cup having a lip on the top edge thereof to have its outer surface brought into rotating contact with the heating surface of the drum without having the cup lip contact the heating surface.

14. The apparatus of claim 2 or 4 wherein the vacuum ports in the vacuum drum surface are disposed to generally define the outline of an annulus sector laid over the surface of the drum, the spacing of such ports being selected such that they lie just inwardly of the edges of a cut label laid over the ports.

15. The apparatus of claim 4 wherein the means for bringing formed cups into rotating contact with the heated labels includes:

(a) an indexer plate mounted for rotation;

(b) the plurality of cup holding mandrels mounted for rotation to the indexer plate and disposed about the periphery thereof, each cup holding mandrel having a front face and a surface shape of a frustum of a cone conforming substantially to the inner surface of the cups to be labeled;

(c) a channel in each of the mandrels extending from an orifice in the front face of each mandrel to an opening at the mounting of the mandrel to the indexer plate;

(d) means for applying a vacuum draw to the channels of the mandrel such that a formed cup is drawn to a mandrel at an intake position and held at a labeling position in which the mandrel has the cup thereon in rotating contract with the vacuum drum surface, and for applying air pressure to the channel in a mandrel which holds a cup which has had a label applied to it when the mandrel reaches a release position;

(e) means for rotating the indexer plate such that each one of the mandrels moves in sequence to the intake position, to the labeling position, and to the release position, with the mandrels dwelling at each such position for a period of time sufficient to allow the mandrel at the labeling position to contact and draw a heated label from the vacuum drum surface onto the surface of the cup; and (f) means for rotatably driving the mandrel which is in the labeling position at a tangential surface speed which is greater than the tangential speed of the vacuum drum surface, whereby contact of the rotating cup with the label will cause the label to be drawn off of the vacuum drum surface onto the surface of the cup at a faster speed than the tangential speed of the vacuum drum surface and thus maintain the label in alignment with the surface of the cup as it is being drawn off.

16. The apparatus of claim 3 wherein the mandrel is driven at a tangential surface speed which is approximately $3\frac{1}{2}$ times greater than the speed of the moving heating surface carrying the heated label.

17. The apparatus of claim 3 wherein each mandrel has a frustum shape adapted to engage the inner surfaces of a frustum shaped cup.

18. The apparatus of claim 3 wherein the means for applying a vacuum draw to the channels of the mandrels includes channels formed in the indexer plate extending to communication with the channels in the mandrels, a stationary manifold having a flat radial face mounted for sliding contact with the front radial face of the indexer plate to which the channels in the plate open, the stationary manifold having a vacuum channel formed therein which communicates with the channels in the indexer plate which themselves communicate with the channels in the mandrels at and between the intake position and the cup release position, and an air pressure channel formed in the stationary manifold portion which is in communication with the channel in the indexer plate which is itself in communication with the channel in the manifold which is in the cup release position.

19. The apparatus of claim 18 wherein each of the mandrels is mounted on one end of a rotating shaft, the shaft being journaled by bearings to the indexer plate and extending therethrough, the driven friction wheel having a beveled friction surface and being mounted to the end of the shaft opposite to the mandrel to rotate therewith, a channel formed in the rotating shaft extending from the orifice in the mandrel to the position at which the shaft is journaled to the indexer plate and extending to the outside surface of the shaft at this position, an annular shaped channel formed about the shaft in the indexer plate and in continuous communication with the channel in the mandrel shaft as it rotates, the channels formed in the indexer plate being in communication with the annular shaped channels.

20. The apparatus of claim 3 wherein the indexer plate is mounted for rotation on a central indexer shaft, and including a sequential dwell cam connected to rotate the indexer shaft.

21. The apparatus of claim 3 wherein the mandrels have a frustum shaped outer surface to allow the mandrels to tightly engage the inner surface of a frustum shaped cup, and wherein the indexer plate is aligned such that the surface of the frustum shaped mandrel in the labeling position adjacent to the drum is parallel to the drum surface.

22. A method of labeling frustum shaped formed cups comprising the steps of:

(a) cutting a label in an annulus sector shape from a web having a heat activable adhesive coated on one side thereof;

(b) supporting the cut label on a moving surface with the adhesive coated side of the label facing away from the surface and the leading edge of the label perpendicular to the direction of motion of the moving surface;

(c) heating the label on the moving surface to activate the adhesive thereon;

(d) rotating a formed cup at a tangential surface speed greater than the speed of the surface on which the label is supported and heated;

(e) contacting the surface of the rotating cup with the heated label on the moving surface with the line of contact of the cup with the surface disposed perpendicularly to the direction of motion of the surface to thereby draw the label off of the surface in proper alignment with the cup and into adhesive contact with the surface of the cup.

23. The method of claim 22 including, simultaneously with supporting the cut label on the surface, applying vacuum draw to the label on the surface to hold the label thereto.

* * * * *